United States Patent [19]

Minnie, Jr.

[11] Patent Number: 4,815,397

[45] Date of Patent: Mar. 28, 1989

[54] SLUDGE TREATMENT APPARATUS

[75] Inventor: Clarence O. Minnie, Jr., St. Clair Shores, Mich.

[73] Assignee: Warren Engineering Corporation, Warren, Mich.

[21] Appl. No.: 72,823

[22] Filed: Jul. 20, 1987

Related U.S. Application Data

[63] Continuation-in-part of Ser. No. 890,095, Jul. 28, 1986, abandoned.

[51] Int. Cl.[4] ..... F23G 5/00

[52] U.S. Cl. ..... 110/223; 432/59; 432/72; 110/257; 110/228

[58] Field of Search ..... 432/72, 59; 110/227, 110/228, 248, 257, 224, 223, 255

[56] References Cited

U.S. PATENT DOCUMENTS

| | | | |
|---|---|---|---|
| 2,481,504 | 9/1949 | Ferro et al. | 110/257 |
| 2,771,847 | 11/1956 | Holbrook | 110/257 |
| 3,289,617 | 12/1966 | Simpson | 110/257 |
| 3,841,242 | 10/1974 | Sigg | 110/257 |
| 3,861,331 | 1/1975 | Saith et al. | 110/257 |
| 3,871,286 | 3/1975 | Heatiksen | 110/257 |
| 3,917,445 | 11/1975 | Suva et al. | 432/141 |
| 4,047,884 | 9/1977 | Heian | 432/72 |
| 4,091,748 | 5/1978 | Mansfield | 110/228 |
| 4,443,185 | 4/1984 | Smith | 432/72 |
| 4,715,810 | 12/1987 | Ramsey et al. | 432/59 |

*Primary Examiner*—Henry C. Yuen

*Attorney, Agent, or Firm*—Krass & Young

[57] ABSTRACT

A method and apparatus for treating sludge from a paint spray booth operation. The sludge from the spray booth is deposited onto a porous belt of a conveyor system to allow the water to pass through the belt where it is collected for discharge from the apparatus. The remaining residue is passed over a vacuum device positioned beneath the belt and is then carried by the belt through an oven comprising a series of infrared thermal reactors arranged in serial fashion over the belt. The sludge is passed continuously beneath the infrared reactors and is dried thereby so that the sludge leaving the apparatus is in a dried particulate form which may be readily disposed of and/or solid. Convection air is recirculated through the apparatus to preheat the incoming sludge, remove smoke and other contaminants from the oven, and provide the desired pressure condition within the oven to optimize the efficiency of the thermal reactors.

13 Claims, 3 Drawing Sheets

58a
50
66
114
142
92
94a
116
94d
94c
158
88
118
90
143
120
122
160
80
128
129
70
76
28
30
42
72
58d
86
84
122
114
90
128
70
76
129
88
80
50

SLUDGE TREATMENT APPARATUS

RELATED APPLICATION

This application is a continuation-in-part of United States patent application Ser. No. 890,095 filed July 28, 1986 now abandoned.

BACKGROUND OF THE INVENTION

This invention relates to systems and apparatus for treating sludge and more particularly to systems and apparatus for treating sludge of the type containing volatiles and a high percentage of water.

Large industrial complexes generate huge quantities of sludge material in the course of their normal day-to-day operations. One example of such sluge is the disposal material resulting from the painting process in automotive assembly facilities. This sludge contains volatile organic compounds and includes water used in the scrubbing operation in the paint spray booth and constituting as much as 90% by volume of the sludge material exiting from the painting operation. This sludge cannot be deposited into the normal sewage facilities but rather must be transported to a landfill. Typically the sludge is mixed with a soda ash before or after transport to the landfill to make it suitable for deposit at the landfill. This total disposal process, involving treating of the sludge and transportation of the sludge, sometimes over long distances, to a suitable landfill is extremely expensive. Further, landfill facilities are becoming increasingly scarce and the ecological requirements for depositing materials in the landfills are becoming more and more stringent. Various proposals have been made to make the sludge disposal process simpler and less expensive but these proposals have not met with any significant degree of commercial success since they have either been ineffective in reducing the complexity and cost of the sludge disposal process, have involved investments in space and capital equipment that have rendered the overall process unattractive from an economical standpoint or have resulted in a final product that is ecologically unacceptable at the landfill facilities.

SUMMARY OF THE INVENTION

This invention is directed to a method and apparatus for efficiently and effectively disposing of waste sludge.

More particularly, this invention is directed to the provision of a method and apparatus for efficiently and effectively disposing of waste sludges having a high water content and including volatiles.

According to the basic methodology of the invention, a substantial portion of the water is initially separated from the sludge and the dewatered remaining sludge is subjected to radiant heat in an amount to dry the remaining sludge, without incineration, to provide a dried particulate. This basic methodology provides an inexpensive and effective means of reducing the sludge to a dried particulate which can be either readily disposed of or sold.

According to a further aspect of the invention, the separating step is accomplished by depositing the sludge onto a moving porous belt to allow the water to pass downwardly through the belt and leave a sludge residue on the belt, and the subjecting step is accomplished by thereafter passing the porous belt carrying the sludge residue through a radiant heat oven. The water is thus effectively and immediately disposed of and the remaining residue is readily reduced to a dried particulate.

According to a further aspect of the invention, the oven includes radiant heaters and the process includes the further step of passing heated convection air through the oven between the belt and the radiant heaters. The convection air has the effect of preheating the sludge prior to entry into the oven, sweeps the oven of undesirable smoke and other contaminants, and precludes the build-up of positive pressure within the oven so as to enable the radiant heaters to continue to operate efficiently.

According to a further feature of the invention, the convection air is heated air taken from the discharge end of the oven and recirculated to the entry end of the oven. This arrangement provides a simple and efficient means of providing the preheat air while simultaneously insuring a smooth and continuous flow of convection air through the oven to remove smoke and contaminants from the oven and maintain the desired pressure conditions within the oven.

According to a further feature of the invention, the moving porous belt is part or a conveyor system and radiant heat is supplied to the dewatered sludge layer as it moves through the oven in an amount sufficient to substantially remove all of the remaining water from the sludge residue so that the sludge arriving at the discharge end of the conveyor is in substantially dried particulate form. In the disclosed embodiment of the invention, the heat applied is infrared heat and the heat is generated in a catalytic reaction process occurring immediately above the moving sludge layer.

The apparatus according to the invention includes an elongated horizontally extending housing having an entry end and a discharge end; an endless elongated conveyor assembly positioned horizontally in the housing and including a porous belt having upper and lower horizontal runs extending substantially from the entry end to the discharge end of the housing; power means operative to drive the conveyor assembly in a sense to move the upper belt run from the housing entry end to the housing discharge end; means for depositing sludge on the upper run of the conveyor belt adjacent the entry end of the housing; means disposed within the housing adjacent the housing entry end beneath the upper belt run operative to receive the water contained in the sludge and passing downwardly through the porous belt upon deposition of the sludge onto the upper belt run by the depositing means and transport the water to a location outside of the housing; and heater means positioned over the upper conveyor belt run between the depositing means and the discharge end of the apparatus and operative to apply radiant heat to the sludge passing therebeneath on the upper conveyor belt run to dry the sludge and reduce it to a dried particulate.

According to a further aspect of the invention, the housing comprises spaced vertically disposed generally parallel side wall structures extending from the entry end to the discharge end of the apparatus; the conveyor assembly is positioned between the side wall structure; the housing includes means defining an entry opening in the housing over the upper conveyor belt run adjacent the entry end of the apparatus; the depositing means is positioned to deliver sludge downwardly onto the upper belt run through the entry opening; and the housing is open between the side structures at the discharge end of the apparatus to allow the particulate to be discharged from the apparatus by gravity discharge from the discharge end of the upper belt run.

According to a further aspect of the invention, the heater means comprises a series of infrared heater units arranged in serial fashion over the upper conveyor belt run so as to serially dry the sludge residue passing therebeneath.

According to a further aspect of the invention, convection air is continuously drawn from the discharge end of the heater means and recirculated to the entry end of the apparatus where it preheats the sludge and thereafter passes through the heater means to remove smoke and other contaminants from the heater means and maintain desired pressure conditions beneath the heater means.

According to a further aspect of the invention, means are also provided to apply a vacuum to the under side of the upper belt run between the depositing means and the heater means to further dewater the sludge.

BRIEF DESCRIPTION OF THE DRAWINGS

FIG. 2 is a cross-sectional view taken on line 2—2 of FIG. 1;

DETAILED DESCRIPTION OF THE PREFERRED EMBODIMENT

Figure 1:
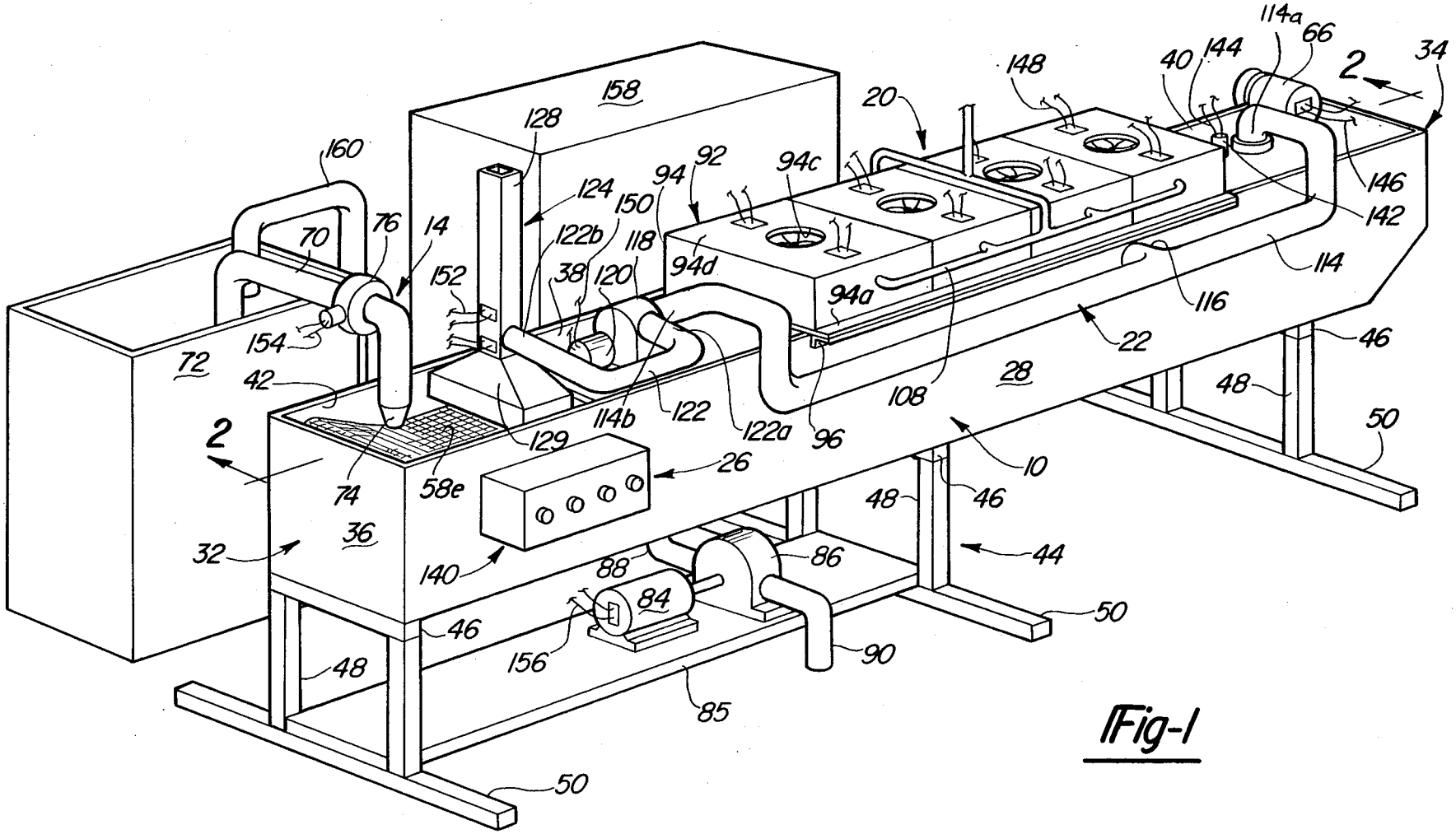
FIG. 1 is a perspective view of the invention sludge treatment apparatus.
Figures 2, 3, 7, 8:
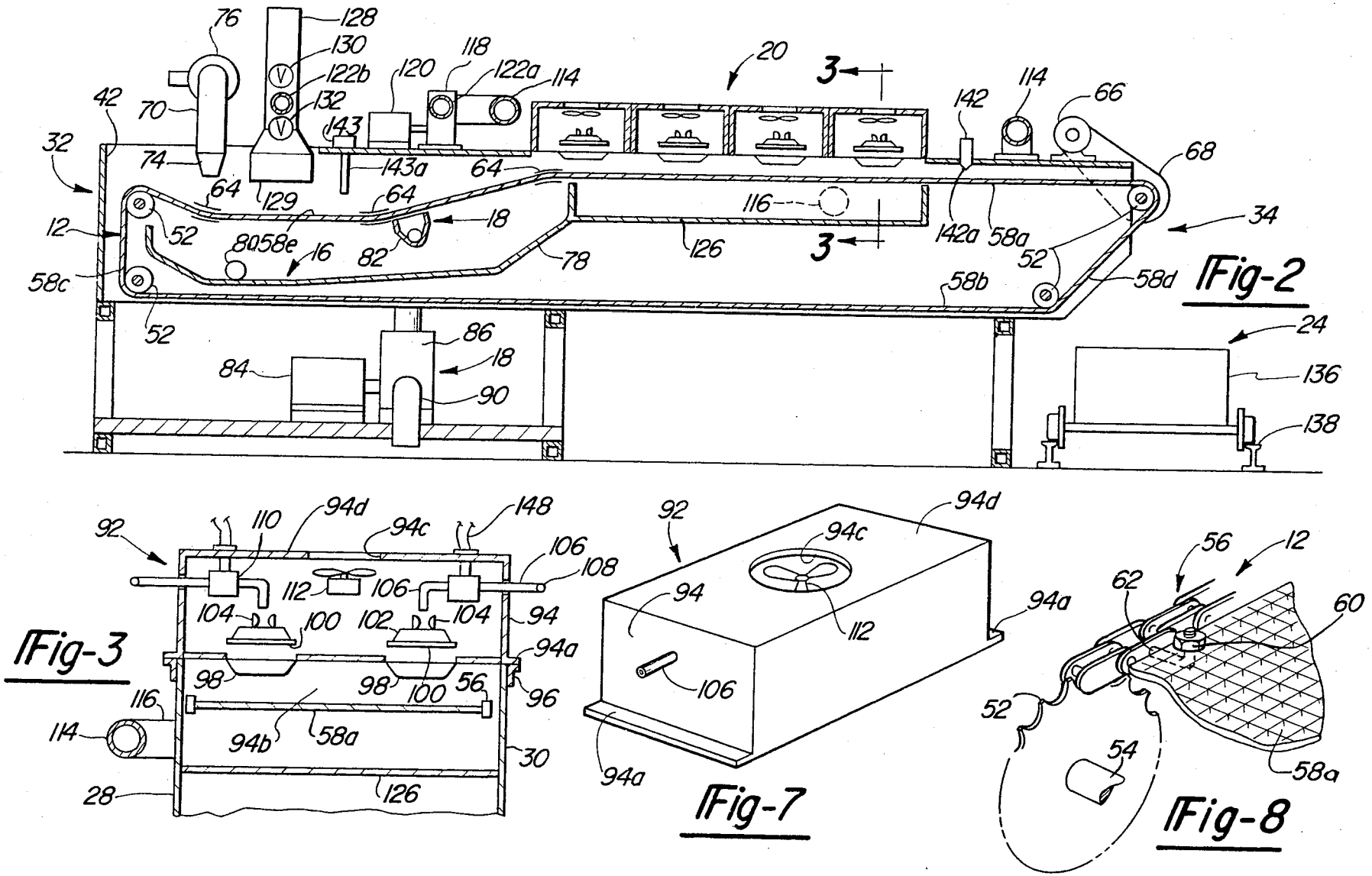
FIG. 2 is a cross-sectional view of the invention sludge treatment apparatus.
FIG. 3 is a cross-sectional view taken on line 3—3 of FIG. 2.
FIG. 7 is a perspective view of an infrared heater unit employed in the invention apparatus.
FIG. 8 is a fragmentary, detailed view of a conveyor system employed in the invention apparatus.
Figures 4, 5, 6:
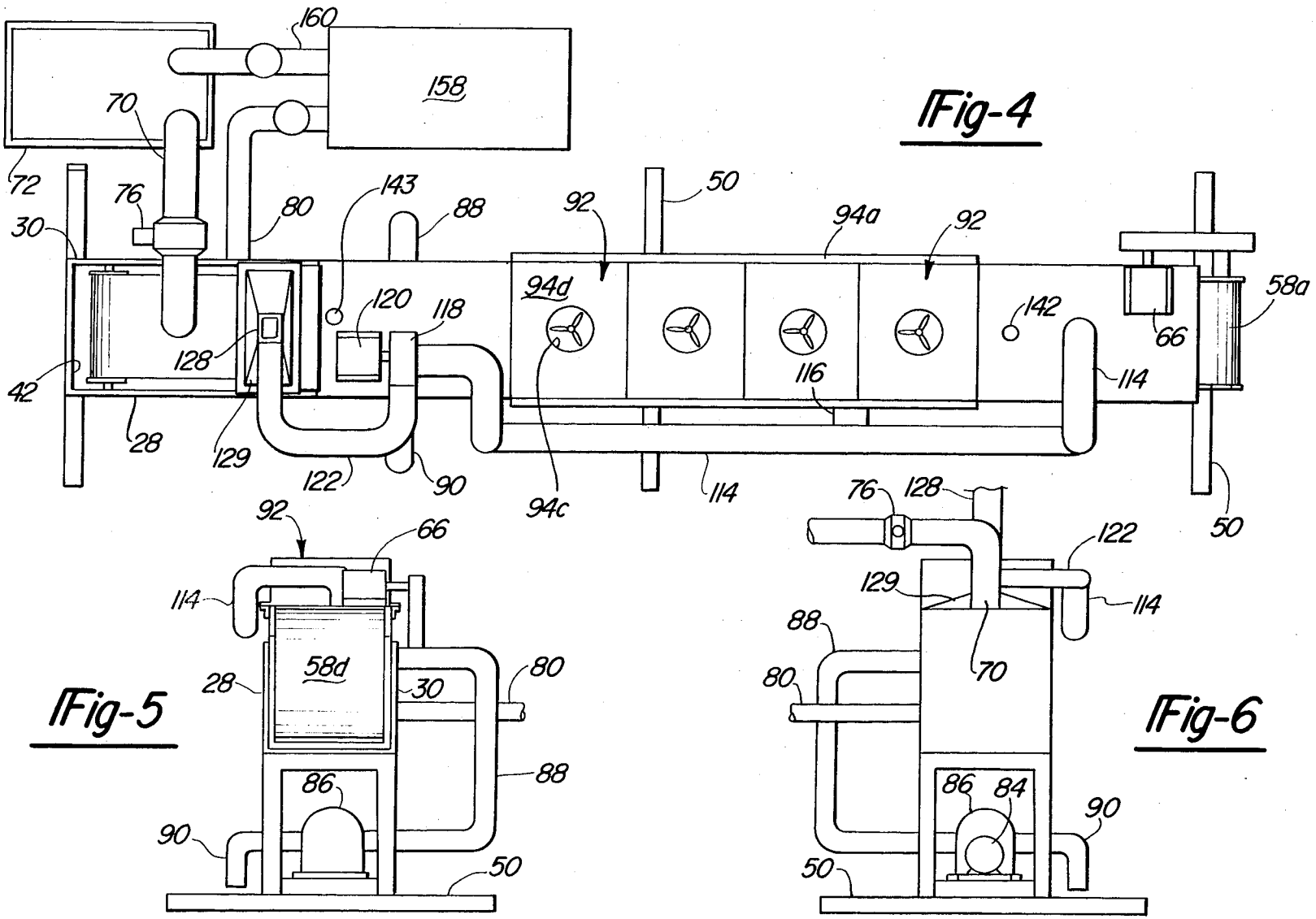
FIG. 4 is a plan view of the invention apparatus.
FIG. 5 is a discharge end view of the invention apparatus.
FIG. 6 is an entry end view of the invention apparatus.

The invention sludge treatment apparatus, broadly considered, includes a housing 10, a conveyor system 12, a delivery system 14, a dewatering system 16, a vacuum system 18, an oven 20, a convection air system 22, a collection system 24, and a control means 26.

Housing 10 is formed of steel or the like and includes spaced elongated side panels 28 and 30 extending in parallel fashion from the entry end 32 to the discharge end 34 of the apparatus, an entry end end plate 36, an entry end top plate 38, and a discharge end top plate 40. The side plates 28 and 30 are open at the discharge end 34 and open along their bottom edges and the entry end top plate 38 is spaced from end plate 36 to define an entry opening 42 adjacent the entry end of the apparatus and communicating with the interior of the housing. Housing 10 is supported in spaced relation over the support surface by a frame structure 44 including longitudinally space horizontal beams 46, vertical columns 48, and transversely extending feet 50.

Conveyor system 12 includes a plurality of sprockets 52 supported on shafts 54 extending transversely between housing side plates 28 and 30, a pair of endless chains 56 respectively training around the left and right sprockets 52 on each shaft 54, and a porous belt 58 carried by chains 56. Belt 58 is preferably formed of 18–24 stainless steel wire mesh screen and is secured to chains 56 by nuts 60 threaded onto the threaded upper end of angle bolts 62 provided at spaced locations along the chains. Sprockets 52 are disposed to provide upper and lower runs for **58*a* and 58*b* for belt 58 interconnected at the entry end of the apparatus by a vertical run 58*c* and interconnected at the discharge end of the apparatus by a vertical run 58*d*. Additionally, guide brackets 64 slidably engage chains 56 adjacent the entry end of the apparatus to define a concavely configured entry section 58*e* of the upper run 58*a*. Conveyor assembly 12 further includes a drive motor 66 position on housing discharge end top plate 40 and driving a chain 68 driving the sprocket shaft 54 at the upper discharge end of the apparatus and thereby driving the entire conveyor assembly. More 66 is driven in a sense to move upper belt run 58*a* from the entry end 32 to the discharge end 34** of the apparatus.

Delivery system 14 includes a pipe 70 communicating with a sludge tank 72 and terminating in a nozzle 74 positioned within entry opening 42. A solenoid controlled valve 76 is positioned in pipe 70 to selectively open and close the pipe.

Dewatering system 16 includes a tray 78 positioned beneath the entry section **58*e* of conveyor upper run 58*a* and extending side-to-side between housing plates 28 and 30, and a discharge pipe 80 positioned at the lower extremity of tray 78** and extending to a location outside of the housing.

Vacuum system 18 includes a vacuum head 82 extending transversely beneath the entry section **58*e* of the belt 58 over tray 78 for substantially the full width of the belt, a motor 84 mounted on a shelf 85 positioned beneath the entry end of the housing, a blower 86 mounted on shelf 85 and driven by the motor, a pipe 88 interconnecting the input of the blower with vacuum head 82, and a discharge conduit 90 connected with the output of the blower 86**.

Oven 20 includes a plurality of thermal reactor units 92 arranged in serial fashion over upper conveyor run **58*a*. Specifically, each thermal reactor unit 92 includes a housing 94 including lower longitudinal flanges 94*a*, and the units 92 are positioned on housing 10 by suitably securing the flanges 94*a* to angle brackets 96 secured to the upper edges of side plates 28 and 30. Units 92 extend from the rear edge of upper housing plate 38 to the forward edge of rear housing plate 40 so that unit 92 coact with plates 38 and 40 to totally enclose the upper side of the housing rearwardly of entry opening 42**.

Each thermal reactor unit 92, in addition to housing 94, includes a pair of grills 98 positioned in laterally spaced locations in the lower or bottom wall **94*b* of the housing, a catalytic pad 100 suitably positioned above each grill 98, a socket housing 102 mounting each catalytic pad 100, a venturi structure 104 associated with the upper end of each socket housing 102, a gas supply pipe 106 positioned centrally above each venturi structure 104 and communicating at its outer end outside of housing 94 with a gas manifold pipe 108, a solenoid valve 110 positioned within housing 94 in association with each gas supply conduit 106 and having a plurality of settings to selectively control the amount of gas flowing through the respective pipe 106, and a central fan 112 positioned within and below a central opening 94*c* in the top wall 94*d* of the housing 94. Each unit 92** may, for example, generally correspond to units available from Sunkiss Thermoreactor, Incorporated of Montreal, Quebec, Canada as Sunkiss Thermoreactor Model No. ARC-TG.

It will be understood that as propane or natural gas is delivered through manifolds 108 and gas supply lines 106 for mixture with primary combustion air drawn in by fan 112, the gas mixture passes downwardly through venturi structure 104. As the gas mixture encounters the catalytic pad 100, a flameless combustion reaction (initiated by an electric heating element, not shown) takes place and infrared heat energy, in wave lengths between 3 and 10 microns, is generated at the catalytic pad and directed downwardly against the upper run 58a of the conveyor belt.

Convection air system 52 includes a conduit 114, an auxiliary conduit 116, a blower 118, a motor 120, a conduit 122 and a preheater 124. Conduit 114 is positioned at one end 114*a* in housing top plate 40 for communication with the interior of the housing beneath top plate 40 and is connected at its other end 114*b* to the inlet of blower 118. Auxiliary conduit 116 passes at one end through housing side plate 28 for communication with the interior of the housing beneath belt upper run 58*a* and adjacent the discharge end of the oven 20, and the other or outer end of auxiliary conduit 116 is connected to conduit 114. A plenum panel 126 is positioned in side-to-side relation between housing side plates 28 and 30 beneath upper belt run 58*a* to facilitate movement of air outwardly through auxiliary conduit 116 for communication with conduit 114. Blower 118 is mounted on housing plate 38, is driven by motor 120, and has its outlet connected to one end 122*a* of conduit 122. The other end of conduit 122 is connected to the stack 128 of preheater 124. Preheater 124 further includes a hood 129 positioned in inlet opening 42 of the housing and a pair of solenoid valves 130 and 132 positioned in stack 128 above and below the end 122*b* of conduit 122. The upper end of stack 128 is suitably vented to the outside of the building in which the apparatus is installed.

Collection system 24 may take various forms and, as illustrated, may include a wheeled cart 136 positioned at and below the discharge end of conveyor assembly 12 and rollably disposed on rails 138.

Control means 26 includes a control panel 140 suitably secured to the side face of housing side plate 28, an infrared thermometer 142 positioned in housing top plate 40 and including a lower probe end 142*a* positioned within the housing over belt upper run 58*a*, and a depth gauge or probe 143 positioned in housing top plate 38 and having a probe 143*a* positioned in spaced overlying relation to belt entry section 58e. Infrared thermometer 142 may comprise, for example, a unit available from Ircon Corporation of Niles, Ill. as Part No. 44-10F-0-1-0, and depth gauge 143 may comprise, for example, a unit available from ASI Instruments, Inc. of Houston, Texas as Part No. AIOILS-STD. Control wires 144 from infrared thermometer 142, control wires 146 from conveyor motor 66, control wires 148 from each thermal reactor control valve 110, control wires 150 from blower motor 120, control wires 152 from solenoid valves 130, 132, control wires 154 from solenoid valve 76, control wires 156 from motor 84, and control wires 157 from depth gauge 143 are each suitably routed to control panel 140. Control panel 140 functions in known manner and responds to the sludge temperature input signal from infrared thermometer 142 and the sludge depth input signal from depth gauge 143 to control the remaining elements of the apparatus in a manner to insure that the desired final dried particulate substance is obtained.

OPERATION

The invention sludge treatment apparatus is intended for use, for example, in connection with a paint spray booth shown schematically at 158. Spray booth 158 includes a conduit 160 for transporting the scrubbing water employed in the spray booth 158 to the sludge tank 72 where it is withdrawn by means of a suitable pump (not shown) through pipe 70 for delivery to nozzle 74. The sludge, containing volatiles and a high percentage of water, is deposited through nozzle 74 and through entry opening 42 onto the concave entry section 58*e* of the upper section 58*a*. As the sludge strikes the entry section 58*e*, the majority of the water contained in the sludge passes downwardly through porous belt 58 for collection in pan 78 and discharge from the apparatus through conduit 80 for return to paint spray booth 158 for reuse in the scrubbing operation. The remainder of the sludge forms a residue layer on the upper face of the belt and is thereafter conveyed by the belt past the vacuum head 82 of vacuum system 18 where further moisture is withdrawn from the residue by the action of blower 86 with the withdrawn moisture being discharged through conduit 90 in the form of moisture-laden air. As the residue is moved further toward the discharge end of the apparatus by the belt, it enters the oven 20 where it is subjected to the radiant heat of the serially arranged thermal reactor units 92.

Specifically, as the sludge layer is moved by the belt beneath the units 92, infrared heat energy in wave lengths between 3 and 10 microns is directed downwardly against the sludge layer moving therebeneath. The setting of the control means 26, including the speed of the belt 58, the volume of sludge delivered to the apparatus through nozzle 74, the thickness of the sludge layer accumulating on belt entry section 58*e* as sensed by depth gauge 143, and the quantity of gas delivered to thermal reactor units, is selectively controlled so that the residue arriving at the discharge end of the upper run of the belt is in dried particulate form. Specifically, the various parameters are adjusted so that all of the moisture is withdrawn from the sludge by the combined action of the dewatering system, the vacuum system, and the thermal reactor units but the sludge is never heated to a combustion temperature so that no incineration takes place.

As the sludge layer moves through the oven, blower 118 functions to draw air through conduit 114 from the area beneath housing top plate 40 and through conduit 116 from the area beneath conveyor run 58*a* for delivery through conduit 122 to preheater 124 where it is directed downwardly through hood 129 and against the residue positioned on the belt entry section 58*e* to preheat the sludge and augment the subsequent action of the thermal reactor units. The air discharged downwardly from the preheater hood 129 moves in a convection path toward the discharge and of the apparatus and passes between the thermal reactor units 92 and the upper belt run 58*a* for subsequent recycling passage through conduits 116 and 114 and back to the preheater. The recycled convection air functions to provide preheat air to augment the drying action of the thermal reactor; provides a cleansing air stream which removes smoke and other comtaminants from the oven; and provides a pressure regulating mechanism for the apparatus by serving to maintain the pressure beneath the thermal reactors at or near atmospheric pressure to thereby facilitate the efficient operation of the thermal reactors. Specifically in this regard, thermal reactors are inefficient when the pressure at the exit end of the reactor exceeds the pressure at the entry end and in fact operate most efficiently when there is a slight pressure drop across the reactors. The convection air flow established by the convection air system 22 insures that a slight pressure drop occurs across the reactors to insure optimal operation of the reactors. The amount of recirculating air respectively directed to the preheater hood 129 and to the stack 128 is controlled by selective operation of solenoid valves 130 and 132. Control 26 is selectively adjusted in a manner to insure that the sludge arriving at the discharge end of the upper run of the conveyor has been reduced to a sintered particulate form for ready collection and disposal. Collection and disposal is accomplished by allowing the dried particulate to drop by gravity into the cart 136 or by any other suitable disposal arrangement. The adjustment of control 26 is such as to selectively vary the thickness of the sludge residue layer, vary the speed of the conveyor, vary the amount of gas delivered to the thermal reactors, vary the amount of sludge delivered through the delivery system 14 so as to insure that the residue arriving at the discharge end of the apparatus has been reduced, without incineration, to the desired dried particulate. It will be understood that the key element in the control system is the infrared thermometer which, by virtue of the probe **142*a*, senses the temperature of the residue leaving the oven 20**. The temperature of the residue at this point is an accurate indicator of the extent to which the residue has been reduced to the desired dried particulate. Specifically, too low a temperature indicates that there is still a significant water constituent in the residue and too high a temperature indicates that undesirable incineration is taking place or is about to take place.

The invention apparatus will be seen to provide a ready and sufficient means of reducing the volume of waste sludge from an industrial facility and thereby substantially reducing the cost of disposing of the sludge. The invention system quickly and effectively reduces the solvent-laden, high water content sludge emitted from a paint spray booth facility to a sintered particulate product occupying only a small fraction of the initial volume of the sludge. This sintered particulate may be readily, transported to a suitable landfill or, alternatively, may be suitably packaged for sale for use in applications requiring a gritty sintered product or for use in forming reconstituted paint. In a typical paint spray application, the volume of the dried particulate emerging from the discharge end of the apparatus comprises 10% by volume of the volume of sludge delivered to the apparatus from the paint spray facility.

Whereas a preferred embodiment of the invention has been illustrated and described in detail it will be apparent that various changes will be made in the disclosed embodiment without departing from the scope or spirit of the invention.

I claim:

1. An apparatus for treating sludge comprising:

(A) an elongated horizontally extending housing having an entry end and a discharge end;

(B) an endless elongated conveyor assembly positioned horizontally in said housing and including a porous belt having upper and lower horizontal runs extending substantially from the entry end to the discharge end of said housing;

(C) power means operative to drive said conveyor assembly in a sense to move said upper belt run from said housing entry end to said housing discharge end while simultaneously moving said lower belt run in return fashion from said housing discharge end to said housing entry end;

(D) means for depositing sludge on said upper run of said conveyor belt adjacent said entry end of said housing;

(E) means disposed within said housing adjacent said housing entry end and beneath said upper belt run operative to receive the water contained in the sludge and passing downwardly through said porous belt upon deposition of the sludge onto said upper belt run by said depositing means and transport the water to a location outside of said housing;

(F) heater means positioned over said upper conveyor belt run between said depositing means and the discharge end of said apparatus and operative to apply radiant heat to the sludge passing therebeneath on said upper conveyor belt run to dry the sludge and reduce it to a dried particulate;

(G) particulate collection means positioned at said discharge end of said housing to receive dried particulate as it is discharged from said belt; and (H) control means operative to preclude combustion of said sludge layer as it moves on said belt through said housing, whereby to provide a dried uncombusted particulate for delivery to said particulate collection means.

2. A sludge processing apparatus according to claim 1 wherein:

(I) said housing comprises spaced vertically disposed generally parallel side wall structures extending from said entry end of said apparatus to said discharge end of said apparatus;

(J) said conveyor assembly is positioned between said side wall structures;

(K) said housing includes means defining an entry opening in said housing over said upper conveyor belt run adjacent said entry end of said apparatus;

(L) said depositing means is positioned to deliver sludge downwardly onto said upper belt run through said entry opening; and (M) said housing is open between said side structures at said discharge end of said apparatus to allow the particulate to be discharged from the apparatus by gravity discharge from the discharge end of said upper belt run.

3. An apparatus according to claim 1 wherein:

(I) said apparatus further includes means for moving convection air through said housing in a path extending beneath said heater means and then downwardly through said upper belt run.

4. An apparatus according to claim 1 wherein said apparatus further includes:

I means operative to apply a vacuum to the under side of said upper belt run between said depositing means and said heater means to further dewater the sludge.

5. An apparatus for treating sludge comprising:

(A) a housing defining an entry end and a discharge end;

(B) an endless conveyor positioned within said housing and including a porous belt having an upper run having an entry end adjacent said entry end of said housing and a discharge end adjacent the discharge end of said housing;

(C) water collection means positioned within said housing beneath said entry end of said belt and operative to transport received water to a location outside of said housing;

(D) means operative to deposit sludge through a housing opening adjacent the entry end of said housing onto a receiving section of said upper belt run adjacent said entry end of said upper belt run so as to allow the water in said sludge to pass downwardly through said receiving section of said porous belt for receipt by said water collection means and provide a layer of dewatered sludge on said entry end of said upper belt run;

(E) means for driving said conveyor in a sense to move said sludge layer on said belt from said entry end of said upper belt run to said delivery end of said upper belt run;

(F) heater means within said housing comprising a plurality of thermal reactors positioned over and along said upper belt run downstream of said water collection means and operative to generate radiant heat energy and direct said energy downwardly against the dewatered sludge layer passing therebeneath on said upper belt run to heat and dry the sludge layer and reduce the sludge layer, without combustion, to a dried particulate;

(G) particulate collection means positioned at said discharge end of said upper belt run to receive said dried particulate as it is discharged from said belt; and (H) control means operative to preclude combustion of said sludge layer as it moves on said belt through said housing, whereby to provide a dried uncombusted particulate for delivery to said particulate collection means.

6. An apparatus according to claim 5 wherein:

(I) each of said thermal reactors includes a catalytic pad and means for supplying a gaseous fuel to said pad for flameless combustion at said pad.

7. An apparatus according to claim 5 wherein said apparatus further includes:

(I) means operative to apply a vacuum to the underside of said upper belt run between said belt receiving section and said heater means.

8. The apparatus of claim 5 wherein:

(I) said control means is operative to preclude combustion of said sludge layer by selectively controlling the thickness of said layer, the speed of said conveyor, and the amount of heat generated by said heater means.

9. The apparatus of claim 5 wherein:

(I) said receiving section of said belt is concavely configured; and (J) said water collection means includes a tray positioned beneath said belt receiving section and conduit means extending from said tray to a location outside of said housing.

10. The apparatus of claim 6 wherein:

(J) said apparatus further includes means for moving convection air across the lower face of said pads between said pads and said sludge layer to facilitate the efficient operation of said pads and remove saturated air from said pads.

11. The apparatus of claim 10 wherein:

(K) said convection air moving means is operative to move said convection air in a path extending across the lower faces of said pads and then downwardly through said sludge layer and porous belt for subsequent return in a closed loop path to said pads.

12. The apparatus of claim 11 wherein:

(L) said connection air moving means includes blower means to move said convection air in said closed loop path.

13. The apparatus of claim 6 wherein:

(J) said housing includes a panel positioned over said upper belt run adjacent said heater means and said pads are positioned in a housing enclosure defined above said panel with each pad positioned over a respective hole in said panel.

* * * * *